US008915767B2

(12) United States Patent
Shen

(10) Patent No.: US 8,915,767 B2
(45) Date of Patent: Dec. 23, 2014

(54) SANDPAPER REPLACEMENT DEVICE

(71) Applicant: Hon Hai Precision Industry Co., Ltd., New Taipei (TW)

(72) Inventor: Chao Shen, Shenzhen (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 119 days.

(21) Appl. No.: 13/847,075

(22) Filed: Mar. 19, 2013

(65) Prior Publication Data

US 2013/0324018 A1 Dec. 5, 2013

(30) Foreign Application Priority Data

Jun. 1, 2012 (CN) ..... 2012 2 02552597 U

(51) Int. Cl.
*B24B 49/00* (2012.01)
*B24D 9/08* (2006.01)
*B24B 37/26* (2012.01)

(52) U.S. Cl.
CPC ..... *B24D 9/085* (2013.01); *B24B 37/26* (2013.01)
USPC ..... 451/8; 451/11; 451/458

(58) Field of Classification Search
CPC ..... B24B 37/26; B24B 37/042; B24B 37/24
USPC ..... 451/5, 8, 11, 56, 458
See application file for complete search history.

(56) References Cited

U.S. PATENT DOCUMENTS 4,712,289 A * 12/1987 Stamm et al. ..... 483/13
6,264,534 B1 * 7/2001 Panyard et al. ..... 451/11

* cited by examiner

*Primary Examiner* — Maurina Rachuba
(74) *Attorney, Agent, or Firm* — Novak Druce Connolly Bove + Quigg LLP

(57) ABSTRACT

A sandpaper replacement device is used for replacing sandpaper of a polishing device, including a support platform, a driver, a driving detector sensor, a clamping member, a clamping detector and a controller. The driver includes a cylinder body and an extension rod movably positioned on the cylinder body. The cylinder body is positioned on the support platform, and the extension rod passing through and protruding out from the support platform. The driving detector sensor is positioned on the support platform adjacent to the extension rod. The clamping member includes a main body and two claws positioned oppositely to each other on the main body. The main body is mounted on the support platform away from the cylinder body. The clamping detector is positioned adjacent to the two claws. The controller is electrically connected to the driver, the driving detector sensor, the clamping detector and the clamping member.

14 Claims, 2 Drawing Sheets

SANDPAPER REPLACEMENT DEVICE

BACKGROUND

1. Technical Field

The present disclosure generally relates to sandpaper-replacement devices, and particularly to a sandpaper-replacement device of an automated polishing line.

2. Description of the Related Art

Robots equipped with polishing tools or devices are used for smoothing out of the workpiece surfaces. The sandpapers that are used during the polishing process need to be replaced after a certain usage time to ensure polishing quality. The used sandpapers are usually manually removed from the polishing devices, and then new sandpapers are supplied and attached or mounted on the polishing devices. However, efficiency of the replacement process for the sandpaper is relative low. In addition, there is a potential for accident due to the danger during the process of manually replacing the sandpapers.

Therefore, there is room for improvement within the art.

BRIEF DESCRIPTION OF THE DRAWING

The components in the drawings are not necessarily drawn to scale, the emphasis instead placed upon clearly illustrating the principles of the present disclosure. Moreover, in the drawings, like reference numerals designate corresponding parts throughout the several views.

DETAILED DESCRIPTION

Figure 1:
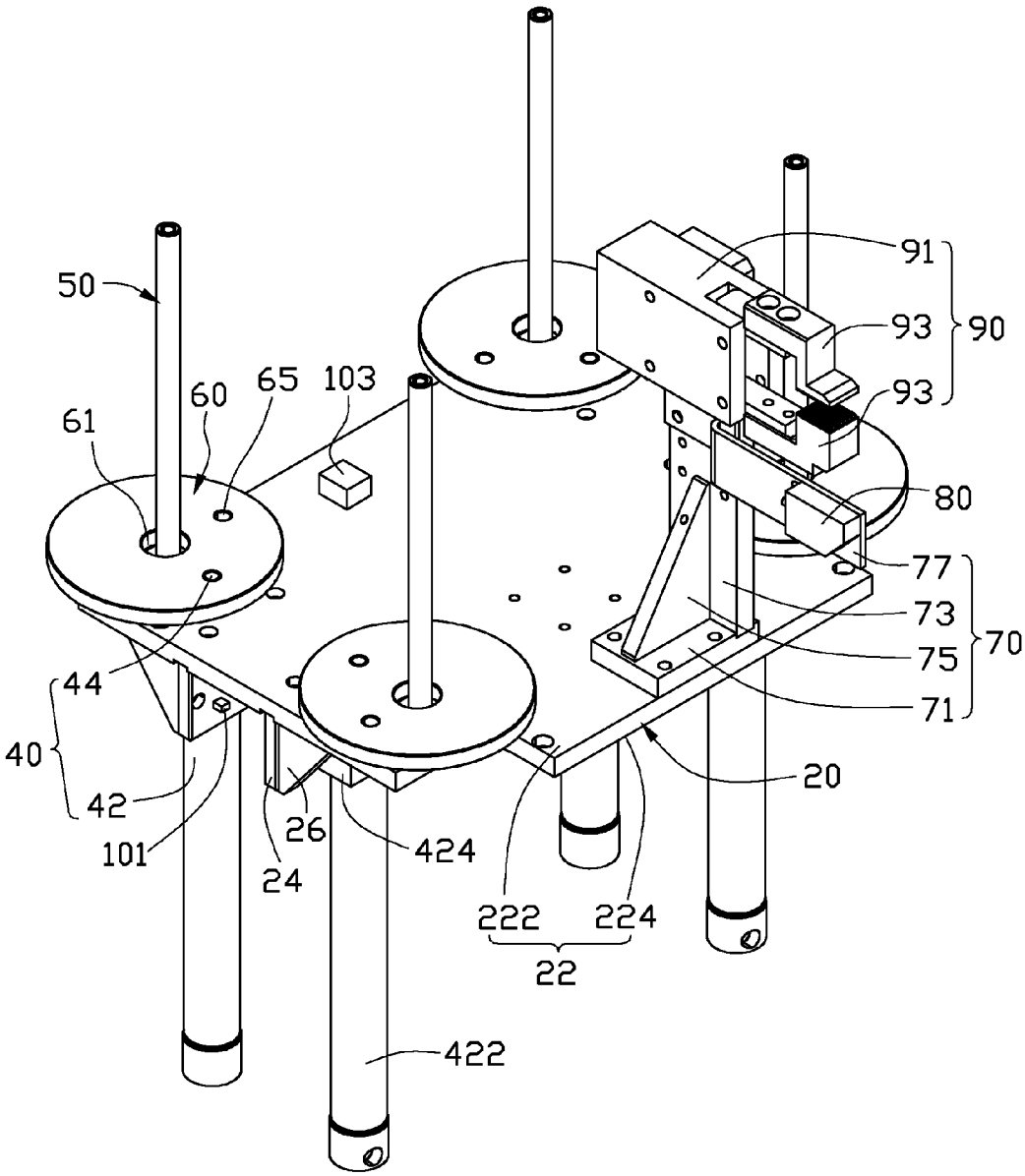
FIG. 1 shows an isometric view of a sandpaper replacement device of an embodiment.
Figure 2:
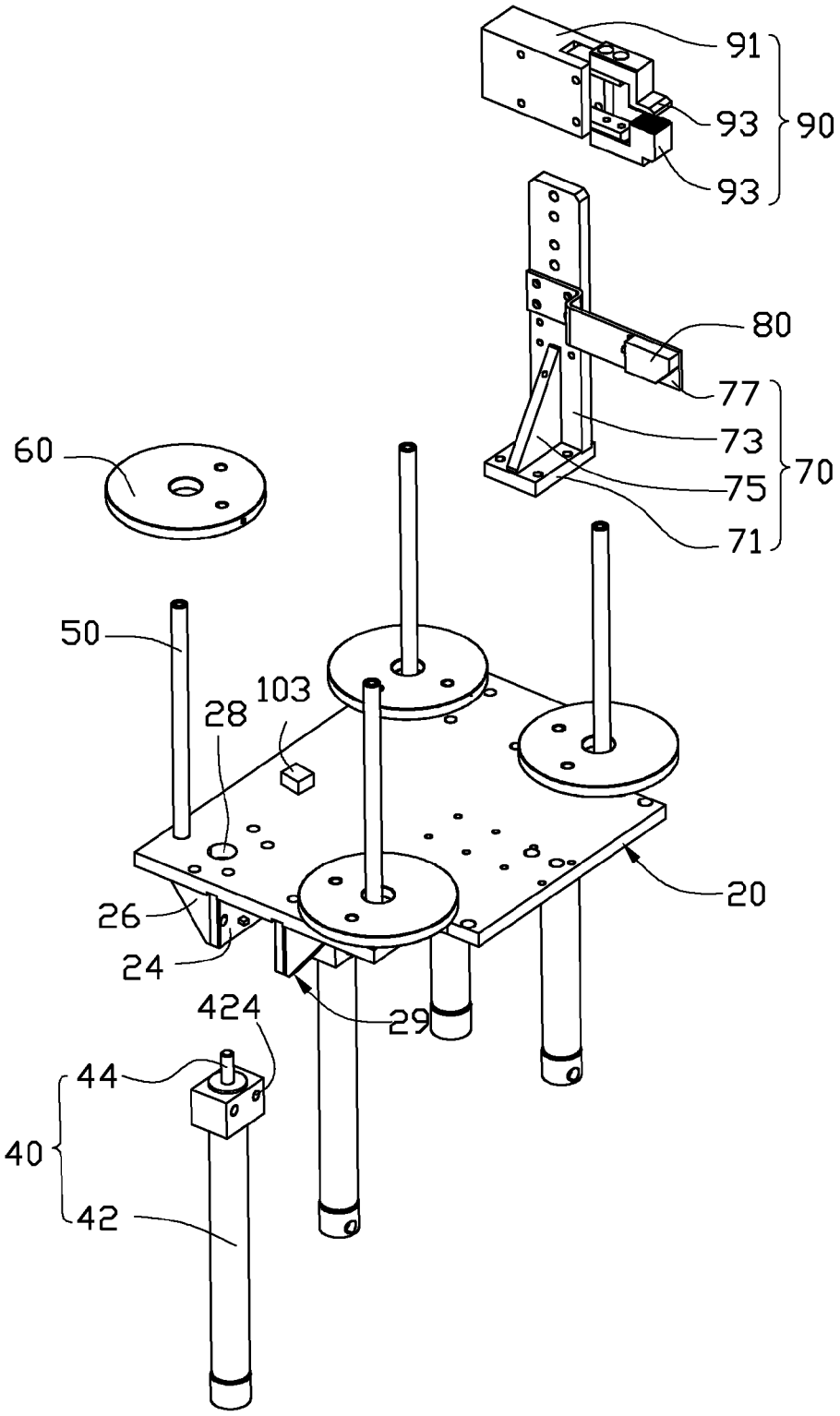
FIG. 2 is an exploded, isometric view of the sandpaper replacement device of FIG. 1.

FIG. 1 shows a sandpaper replacement device 100 of an embodiment of present disclosure. The sandpaper replacement device 100 is applied, adapted and used for replacing sandpaper used in a polishing device (not shown). The polishing device includes an attachment plate (not shown). The sandpaper is mounted, attached or adhered to the attachment plate for performing polishing. In the illustrated embodiment, the sandpaper replacement device 100 can be configured and applied to replace sandpapers for four polishing devices.

The sandpaper replacement device 100 includes a support platform 20, four drivers 40, four driving detector sensors 101, four guiding members 50, four discharge plates 60, an installation assembly 70, a clamping detector 80, a clamping member 90, and a controller 103. Each of the drivers 40 partially passes through and protrudes out from the support platform 20. Each driving detector sensor 101 is positioned adjacent to one corresponding driver 40. Four guiding members 50 are mounted on the support platform 20 for guiding the transport or movement of the sandpaper during a replacement process of the sandpaper. Each discharge plate 60 sleeves on one of the four guiding members 50 to support the sandpapers. The installation assembly 70 is mounted on the support platform 20 adjacent to the discharge plates 60. The clamping detector 80 and the clamping member 90 are positioned on the installation assembly 70. The controller 103 is electrically connected to the four drivers 40, the four driving detector sensors 101, the clamping detector 80, and the clamping member 90 to control the sandpaper replacement device 100. The clamping detector 80 is configured for detecting as to whether the sandpaper needs to be replaced upon arriving to a first preset position, and then sending a first signal to the controller 103. The controller 103 controls the clamping member 90 to clamp and tear off the used and worn sandpaper to be replaced according to the first signal. The driving detector sensors 101 are used for detecting as to whether the polishing devices need to be supplied with new sandpaper when arriving at a second preset position, and then sending a second signal to the controller 103. The controller 103 controls the drivers 40 to drive the discharge plates 60 to push new sandpaper to the attachment plates of the polishing device. In other embodiments, the number of the drivers 40 are matched to be corresponding to the number of the polishing devices, and the number of the guiding members 50 and of the discharge plates 60 are matched corresponding to the number of the drivers 40.

The support platform 20 includes a support board 22, four fixing blocks 24, and eight support blocks 26. The support board 22 includes a first mounting surface 222 and a second mounting surface 224 opposite to the first mounting surface 222. Four through holes 28 are defined in the support board 22 adjacent to four corners of the support board 22. Each fixing block 24 is fixed on the second mounting surface 224 adjacent to one through hole 28. The four fixing blocks 24 are substantially parallel to each other. Each pair of two support blocks 26 are substantially perpendicularly connected with two sides of one corresponding fixing block 24 to form a receiving space 29, and are substantially parallel to each other.

Four drivers 40 are positioned on a stable plane, (eg. floor, or a table). Each driver 40 includes a cylinder body 42 and an extension rod 44 movably positioned on one end of the cylinder body 42. The cylinder body 42 includes a cylinder tube 422 and an installation block 424 positioned at an end of the cylinder tube 422 adjacent to the extension rod 44. The installation block 424 is mounted on a side surface of the fixing block 24 and is received in the receiving space 29. The extension rod 44 passes through the through hole 28 and protrudes out from the first mounting surface 222. In the illustrated embodiment, the drivers 40 are pen cylinders. Each driving detector sensor 101 is mounted on one of the four fixing blocks 24. In other embodiments, the driving detector sensors 101 can be positioned at other components adjacent to the extension rod 44.

The guiding members 50 are mounted on the first mounting surface 222. Each of the guiding members 50 is positioned adjacent to one corresponding through hole 28 and one corresponding extension rod 44. The guiding member 50 is substantially a rod.

The discharge plate 60 is substantially a circular plate. Each discharge plate 60 sleeves on one corresponding guiding member 50 above the support board 22 and is fixedly connected to an end of the extension rod 44 away from the cylinder body 42. A sleeve hole 61 is defined in a center of the discharge plate 60 for allowing the discharge plate 60 to sleeve on the guiding member 50. Two mounting holes 65 are defined in the discharge plate 60 adjacent to the sleeving hole 61, and are spaced from each other. Inner walls of the mounting holes 65 are threaded. The extension rod 44 is screwed in one of the two mounting holes 65. In the illustrated embodiment, a shape and a size of the discharge plate 60 corresponds to the size required by the sandpaper so as to allow the drivers 40 to be able to push and lift up the sandpaper conveniently.

The installation assembly 70 includes a bottom board 71, an installation board 73, a strengthening member 75, and a mounting member 77. The bottom board 71 is mounted on the first mounting surface 222 adjacent to one edge thereof. The installation board 73 is substantially perpendicularly connected to one end of the bottom board 71 and extends toward a direction away from the bottom board 71. The strengthening member 75 is a substantially right triangular board for strengthening the support of the installation board 73. One right-angled edge of the strengthening member 75 is substantially perpendicularly connected with the bottom board 71. Another right-angled edge of the strengthening member 75 is substantially perpendicularly connected with the installation board 73. The mounting member 77 is a substantially bent board, which is mounted on a side surface of the installation board 73 that is connecting with the strengthening member 75, and is positioned above the strengthening member 75. The mounting member 77 is positioned substantially parallel to the support board 22, and extends out of the support board 22. The clamping detector 80 is positioned on an end of the mounting member 77 away from the installation board 73.

The clamping member 90 is installed on the installation board 73 away from the bottom board 71 and above the mounting member 77. The clamping member 90 includes a main body 91 and two claws 93. The main body 91 is connected with an end of the installation board 73. The claws 93 are oppositely positioned on one end of the main body 91 facing outside of the support platform 20. The main body 91 is capable of driving the two claws 93 to clamp or release the used or worn out sandpaper. In the illustrated embodiment, the clamping member 90 is a jaw cylinder.

In assembly, the fixing blocks 24 and the support blocks 26 are mounted on the first mounting surface 222. The installation block 424 of each driver 40 is fixedly assembled with one corresponding fixing block 24, and the extension rod 44 protrudes out from the first mounting surface 222. The guiding members 50 are positioned on the first mounting surface 222. Each of the discharge plates 60 sleeves on one corresponding guiding member 50, and is fixedly-connected with the extension rod 44. The bottom board 71 is positioned on the first mounting surface 222. The installation board 73 is connected with the bottom board 71. The strengthening member 75 is connected with the installation board 73 and the bottom board 71, respectively. The mounting member 77 is fixed on the installation board 73 away from the bottom board 71. The clamping detector 80 is positioned on the mounting member 77. Each driving detector sensor 101 is mounted on one corresponding fixing block 24. The clamping member 90 is positioned on the installation board 73. The controller 103 is electrically connected with the drivers 40, the driving detector sensors 101, the clamping member 90 and the clamping detector 80.

In use, a plurality of stacked new sandpapers are sleeved on each guiding member 50 at above the discharge plate 60. Using the replacement of sandpaper on one of the polishing devices as an illustrative example, the polishing device is driven to arrive at the first preset position when the used or worn out sandpaper is needed to be replaced. The clamping detector 80 sends the first signal to the controller 103 when the clamping detector 80 detects that the polishing device has arrived at the first preset position. The controller 103 controls the clamping member 90 to close the two claws 93 to grip the used sandpaper. The polishing device is driven to move relative to the clamping member 90 according to a preset path, and pull and remove the used sandpaper from the polishing device. The two claws 93 then release the used sandpaper. Later, the polishing device is driven to arrive at the second preset position, and the attachment plate is positioned above the discharge plate 60. The driving detector sensor 101 sends the second signal to the controller 103 when the clamping detector 80 detects that the polishing device has arrived at the second preset position. The controller 103 controls the driver 40 to push the discharge plate 60 to the attachment plate of the polishing device. Then the new sandpaper on the discharge plate 60 is adhered, attached or mounted to the attachment plate. The extension rod 44 returns to its original position.

The sandpaper replacement device 100 with a simple structure is capable of automatically replacing sandpaper of the polishing devices. The clamping member 90 clamps and tears off the used sandpaper from the polishing devices. The extension rod 44 is capable of pushing the new sandpaper to the attachment plates. Therefore, the efficiency of replacing the sandpaper will be improved. Time and labor consumption used for sandpaper replacement will be saved or reduced. In addition, the shape and the size of the discharge plate 60 allows the sandpaper to be conveniently pushed by the drivers 40. Further, the guiding members 50 guide the movement and transport of the sandpaper during the sandpaper replacement procedure and process.

In other embodiments, the number of the clamping members 90 can be changed as needed.

In other embodiments, the discharge plates 60 and the guiding members 50 can be omitted, and the sandpaper is then directly placed on the support board 22 so that the sandpaper can be pushed by the extension rods 44 to the polishing devices.

In other embodiments, the installation assembly 70 can be omitted, the clamping member 90 and the clamping detector 80 are positioned apart on the support board 22.

While the present disclosure has been described with reference to particular embodiments, the description is illustrative of the disclosure and is not to be construed as limiting the disclosure. Therefore, various modifications can be made to the embodiments by those of ordinary skill in the art without departing from the true spirit and scope of the disclosure, as defined by the appended claims.

What is claimed is:

1. A sandpaper replacement device used for replacing sandpapers for a polish device, comprising:

a support platform;

a driver comprising a cylinder body and an extension rod movably positioned on the cylinder body, the cylinder body being positioned on the support platform, and the extension rod passing through and protruding out from the support platform;

a driving detector sensor positioned on the support platform adjacent to the extension rod;

a clamping member comprising a main body and two claws oppositely positioned on one end of the main body, and the main body being mounted on the support platform away from the cylinder body;

a clamping detector positioned adjacent to the two claws; and a controller electrically connected to the driver, the driving detector sensor, the clamping detector and the clamping member, wherein when the clamping detector detects sandpaper needing to be replaced having arrived at a first preset position, the clamping detector sends a first signal to the controller, the controller controls the clamping member to grip and tear off the sandpaper for replacement from the polishing device according to the first signal, when the driving detector sensor detects the polishing device needing to be supplied new sandpaper having arrived at a second preset position, the driving detector sensor sends a second signal to the controller, and the controller controls the driver to push up the new sandpaper to the polishing device according to the second signal.

2. The sandpaper replacement device of claim 1, wherein the sandpaper replacement device further comprises a guiding member positioned on a side of the support platform away from the cylinder body adjacent to the extension rod.

3. The sandpaper replacement device of claim 2, wherein the sandpaper replacement device further comprises a discharge plate sleeving on the guiding member, and fixedly connected with the extension rod.

4. The sandpaper replacement device of claim 3, wherein a mounting hole is defined in the discharge plate adjacent to the guiding member, and the extension rod is screwed in the mounting hole.

5. The sandpaper replacement device of claim 1, wherein the support platform comprises a support board and a fixing block fixed on the support board, the cylinder body comprises a cylinder tube and an installation block positioned adjacent to the extension rod, and the installation block is connected with the fixing block.

6. The sandpaper replacement device of claim 5, wherein the support platform comprises two support blocks, the two support blocks are substantially perpendicularly connected with two sides of the fixing block to form a receiving space, and the installation block is mounted on a side surface of the fixing block and is received in the receiving space.

7. A sandpaper replacement used for replacing sandpapers for a polish device, comprising:

a support platform;

a driver comprising a cylinder body and an extension rod movably positioned on the cylinder body, the cylinder body being positioned on the support platform, and the extension rod passing through and extending out from the support platform;

a driving detector sensor positioned on the support platform adjacent to the extension rod;

an installation assembly mounted on a side of the support platform away from the cylinder body;

a clamping member comprising a main body and two claws oppositely positioned on one end of the main body, and the main body mounted on the installation assembly;

a clamping detector positioned on the installation assembly adjacent to the two claws; and a controller electrically connected with the driver, the driving detector sensor, the clamping detector and the clamping member, wherein when the clamping detector detects sandpaper needing to be replaced having arrived at a first preset position, the clamping detector sends a first signal to the controller, the controller controls the clamping member to grip and tear off the sandpaper for replacing from the polishing device according to the first signal, when the driving detector sensor detects the polishing device needing to be supplied new sandpaper having arrived at a second preset position, the driving detector sensor sends a second signal to the controller, and the controller controls the driver to push up the new sandpaper to the polishing device according to the second signal.

8. The sandpaper replacement device of claim 7, wherein the installation assembly comprises a bottom board, an installation board and a mounting member, the bottom board is mounted on the support platform away from the cylinder body, the installation board is substantially perpendicularly connected with the bottom board, the mounting member is mounted on the installation board away from the bottom board, the clamping member is positioned on the installation board above of the mounting member, and the clamping detector is positioned on the mounting member.

9. The sandpaper replacement device of claim 8, wherein the installation assembly comprises a strengthening member, the strengthening member is connected with the bottom board and the installation board, and the mounting member is positioned above the strengthening member.

10. The sandpaper replacement device of claim 7, wherein the sandpaper replacement device further comprises a guiding member positioned on a side of the support platform away from the cylinder body adjacent to the extension rod.

11. The sandpaper replacement device of claim 10, wherein the sandpaper replacement device further comprises a discharge plate sleeving on the guiding member and fixedly connected with the extension rod.

12. The sandpaper replacement device of claim 11, wherein a mounting hole is defined in the discharge plate adjacent to the guiding member, and the extension rod is screwed in the mounting hole.

13. The sandpaper replacement device of claim 7, wherein the support platform comprises a support board, and a fixing block, the fixing block is fixed on the support board, the cylinder body comprises a cylinder tube and an installation block positioned adjacent to the extension rod, and the installation block is connected with the fixing block.

14. The sandpaper replacement device of claim 13, wherein the support platform comprises two support blocks, the two support blocks are substantially perpendicularly connected with two sides of the fixing block to form a receiving space, and the installation block is mounted on a side surface of the fixing block facing towards the receiving space and is received in the receiving space.

* * * * *